US005146693A

United States Patent [19]

Dottor et al.

[11] Patent Number: 5,146,693

[45] Date of Patent: Sep. 15, 1992

[54] STEAM CONDENSATION DEVICE IN A DRYER OR COMBINATION WASHER/DRYER

[75] Inventors: Giambattista Dottor; Silvano Cimetta, both of Treviso, Italy

[73] Assignee: Industrie Zanussi S.p.A., Pordenone, Italy

[21] Appl. No.: 617,888

[22] Filed: Nov. 26, 1990

[30] Foreign Application Priority Data

Dec. 1, 1989 [IT] Italy ..... 34090 B/89

[51] Int. Cl.[5] ..... F26B 21/06

[52] U.S. Cl. ..... 34/77; 34/133 A; 34/73; 34/133 J; 165/156

[58] Field of Search ..... 34/76, 77, 73, 27, 133, 34/133 A, 133 J, 133 M-133 Q; 165/156, 111

[56] References Cited

U.S. PATENT DOCUMENTS

| | | | |
|---|---|---|---|
| 1,865,255 | 6/1932 | Jacocks | 165/156 |
| 1,964,890 | 7/1934 | Neeson | 165/156 |
| 2,310,680 | 2/1943 | Dinley | 34/77 |
| 2,453,859 | 11/1948 | Pugh | 34/77 |
| 3,113,445 | 12/1963 | Williams et al. | 34/76 |
| 3,186,106 | 6/1965 | Cobb et al. | 34/77 |
| 4,154,003 | 5/1979 | Müller | 34/77 |
| 4,850,119 | 7/1989 | Führing | 34/27 |

*Primary Examiner*—Henry A. Bennet
*Assistant Examiner*—Denise L. F. Gromada
*Attorney, Agent, or Firm*—Wenderoth, Lind & Ponack

[57] ABSTRACT

A steam condensation device is provided in a dryer or combination washer/dryer for condensing hot water vapor carried by hot air used to dry laundry in the dryer or combination washer/dryer. The steam condensation device includes a vertically extending tubular casing, at least one condenser conduit extending vertically within and spaced from the casing so as to define an annular space therebetween, and a spiral wall disposed between respective internal and external surfaces of the at least one condenser conduit and the casing. The spiral wall extends spirally toward the lower end of the at least one condenser conduit so as to define a spiral conveying path alongside the external surface of the at least one condenser conduit. The condensation device is arranged so that hot air circulating through the interior of the rotating basket containing laundry in the machine passes through the interior of the at least one condensor conduit. Cold water is supplied onto the spiral wall whereas it is conveyed spirally alongside the external surface of the at least one condenser conduit so as to cool the same. Thus, water vapor contained in the hot air passing through the interior of the at least one condenser conduit is cooled and consequently condensed.

15 Claims, 1 Drawing Sheet

STEAM CONDENSATION DEVICE IN A DRYER OR COMBINATION WASHER/DRYER

BACKGROUND OF THE INVENTION

The present invention relates to a condensation device for dryers or combination washers/dryers of household laundry, capable of condensing in a simple and efficacious manner the water vapor produced during the drying of the laundry.

As is known in laundry dryers or combination washers/dryers, at least one condensation device in the form of a condenser is provided to condense water vapor produced during drying cycles in the dryer or combination washer/dryer. Such a condenser generally comprises a tubular casing connected to upper and lower parts of the tub of the machine via a suitable ventilation device for circulating hot air through laundry contained in the tub. A condenser conduit is also provided which is connected with the cold water source in the machine. The cold water source introduces a continuous flow of cold water inside the condenser to condense hot water vapor in the air circulating through the condenser.

Such condensers function in a satisfactory and reliable manner; however, such condensers do not operate at a high efficiency with respect to the elimination of the water vapor. Specifically, the condensing of the water vapor in the circulating hot air is predominantly carried out while the cold water circulating inside the condenser travels at a relatively high speed past the circulating hot air containing the water vapor. Owing to such circumstances, it is not possible to achieve efficacious cooling of the water vapor and consequently, a limited amount of the water vapor may be condensed. Further, it is difficult to expect that the drying of laundry within a predetermined period of time could be increased in a dryer or combination washer/dryer employing such a condenser. And, it is also difficult to expect that such a dryer or combination washer/dryer could exhibit a relatively low energy consumption characteristic.

OBJECT OF THE INVENTION

In light of the problems above, an object of the present invention is to provide a steam condensation device in a dryer or combination washer/dryer which exhibits a high degree of efficiency in the elimination of water vapor produced by laundry during the drying of the same, and which contributes to reducing the amount of energy required to dry laundry within a predetermined maximum time period.

BRIEF DESCRIPTION OF THE DRAWINGS

The present invention will be better understood from the following description made with reference to the accompanying drawings, in which.

DETAILED DESCRIPTION OF THE PREFERRED EMBODIMENTS

Figure 1:
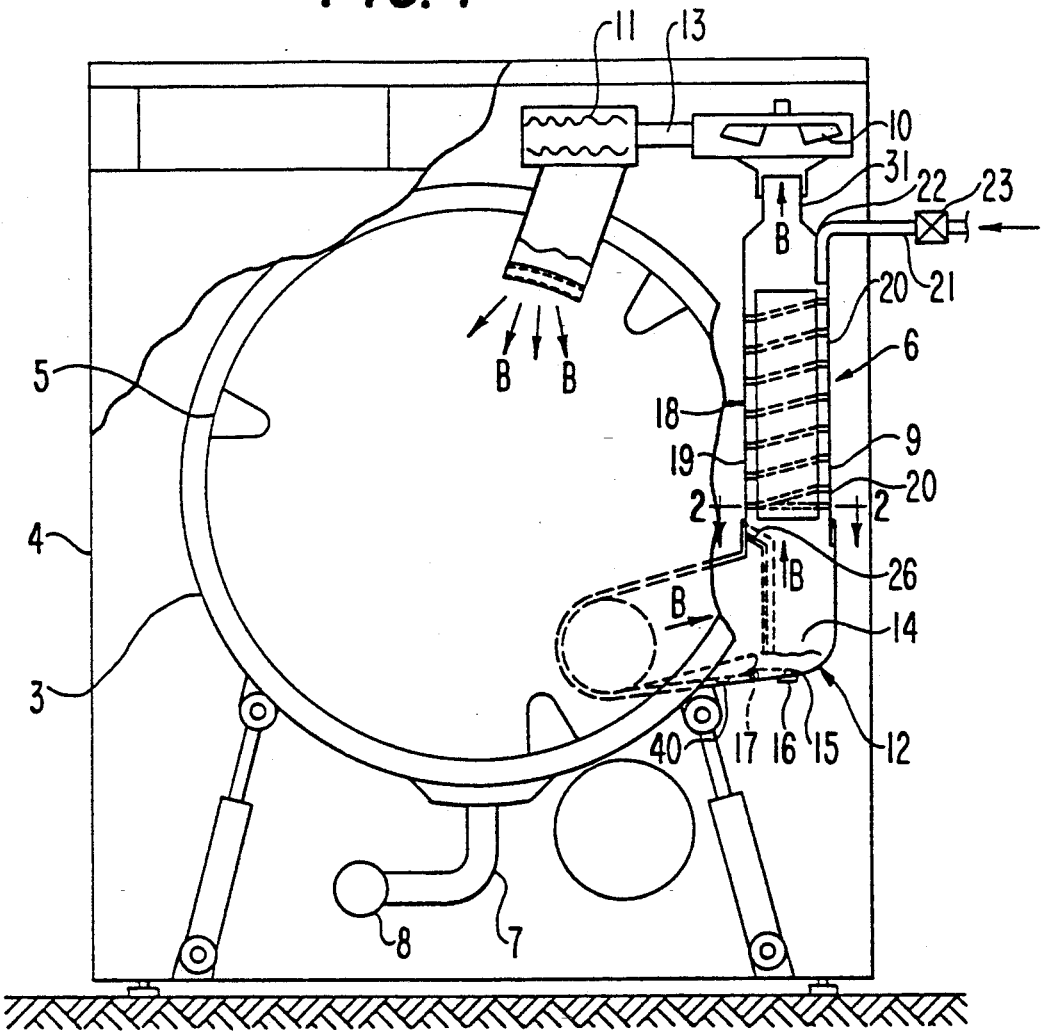
FIG. 1 is a front schematic view, partly cut-away, of a combination washer/dryer for laundry incorporating a steam condensation device according to the present invention.

Referring now to FIG. 1, there is shown a combination washer/dryer comprising a conventional washing tub 3 supported within a metal housing 4, a basket 5 for containing laundry and rotatably supported in the housing 4 within washing tub 3, and hot air circulation means including a ventilation fan 10 and an electric heater 11 represented by the electric heating elements shown. The hot air circulation means circulates hot air through the interior of basket 5 along a drying circuit in the direction of arrows B from a lower part of the basket to an upper part of the basket to dry laundry previously washed and contained in the basket. Connected in the drying circuit is a steam condensation device 6 for condensing vapors in the hot air generated and circulated by the ventilation fan 10 and electric heater 11. The washing tub 3 is provided at the bottom part thereof with a flexible discharge pipe 7 and discharge pump 8. The discharge pipe 7 and discharge pump 8 form part of a system for selectively introducing washing liquid into the tub 3 and discharging such washing liquid from the tub 3 during the washing cycles of the machine, or for discharging liquid including condensation at the bottom of the tub 3 during the drying cycle of the machine.

The condensation device 6 extends between and is connected to the lower and upper parts of the tub 3. As shown in the figure, the condensation device 6 is connected with the upper part of the tub 3 via the at least one ventilation fan 10 and electric heating element of the electric heater 11 which together establish a flow of hot air during the drying cycle of the machine along the drying circuit extending through the interior of basket 5. In a conventional dryer, the condensation device 6 is connected to upper and lower parts of a rotating basket in a manner similar to that illustrated in FIG. 1. That is, the upper part of the condensation device is connected with an upper part of the rotating basket via at least one ventilation fan and electrical heating element which establish a flow of hot air through the basket in the dryer. In addition, a discharge pump may be connected to the condensation device for specifically discharging condensate formed by the condensation of water vapor picked up by the hot air during the course of drying the laundry in such a dryer.

Figure 2:
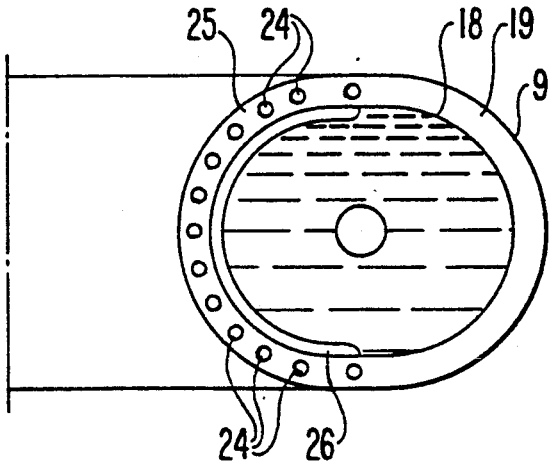
FIG. 2 is a sectional view taken along line 2—2 in FIG. 1.

The condensation device 6 according to the present invention includes a tubular casing 9 extending vertically in the housing 4. The tubular casing 9 is preferably molded so as to have a main body portion having an elliptical cross-sectional shape as shown in FIG. 2, and a tapered upper part 31. Needless to say, the tubular casing 9 may be molded so as to have a different geometric shape. Conduit structure 13 houses ventilation fan 10 and the heating elements of electric heater 11, and the condensation device 6 is connected to the upper part of the tub 3 by the connection of the tubular housing 9 to conduit 13. On the other hand, conduit structure 12 is open to the interior of the washing tub 3 at a lower part thereof, and the tubular casing 9 is connected to the conduit structure 12.

At least one condenser conduit 18 extends vertically within casing 9 for almost the entire length of the casing. The at least one condenser conduit 18 has a diameter that is less than that of the casing 9 and is supported therein at a central position so that an annular space 19 is defined between internal and external surfaces of casing 9 and at least one condenser conduit 18, respectively.

The at least one condenser conduit 18 has a lower end terminating at the zone of connection of the casing 9 to conduit structure 12 and is therefore able to communicate with the lower part of basket 5. On the other hand, the at least one condenser conduit 18 has an upper end communicating with the upper part of the basket 5 via the ventilation fan 10 and electric heater 11. Thus, the at least one condenser conduit 18 is connected in the drying circuit in a manner which allows hot air to pass therethrough in a closed loop during the drying cycle of the machine.

A tube 21, connected to the system for supplying cold water in the machine, extends through an opening 22 in the upper part of casing 9. The tube 21 serves as cold water supply means open to the annular space 19 for introducing a supply of cold water into the condensation device at a location between the at least one condensing conduit 18 and casing 9. An electrically operated regulator valve 23 is interposed between tube 21 and the source of cold water and is operable to selectively deliver a flow of cold water to tube 21.

A spiral wall 20 is disposed between the respective internal and external surfaces of the at least one condenser conduit 18 and the casing 9. The spiral wall 20 extends spirally from the above-mentioned location along the entirety of the annular space 19 toward the lower end of the at least one condenser conduit 18. The spiral wall 20 thus defines a spiral conveying path alongside the external surface of the at least one condenser conduit 18. Cold water from the cold water supply means can travel along such a spiral conveying path to cool the at least one condenser conduit 18 and thereby condense vapors in hot air passing therethrough in a manner which will be described in more detail below.

The conduit structure 12 extends between the lower part of basket 5 and the lower end of the at least one condenser conduit 18 and defines a small well 14 below the lower end of the at least one condenser conduit 18 for accumulating condensate of vapors in hot air passing through the at least one condenser conduit 18. More particularly, the conduit structure 12 includes an upwardly inclined wall 17 terminating at a lateral edge forming an upper part of the well 14 so as to limit the extent of well 14. The wall 17 is molded with the conduit structure 12 or is fabricated in some other appropriate way and defines what can be referred to as "a touching edge" for the condensate contained in the well 14. Condensate accumulating in the well 14 past the "touching edge" will flow down along wall 17 through the conduit 12 and toward the inside of tub 3.

Still further, the conduit structure 12 defines a cleaning aperture 15 therethrough which is closed by a removable plug 16. The plug 16 and cleaning aperture 15 allow access to the inside of well 14 so that the same may be cleaned.

As seen in both FIG. 1 and FIG. 2, the spiral wall 20 has a bottom portion 25 extending in a loop around the at least one condenser conduit 18. The bottom portion 25 of spiral wall 20 defines a plurality of openings 24 there-through. Cold water traveling along the spiral conveying path defined by spiral wall 20 can penetrate through the bottom portion 25 of the spiral wall via these openings 24 to pass to accumulation well 14.

Advantageously, a deflector 26 extends below the openings 24 defined by the bottom portion 25 of the spiral wall 20. Preferably, the deflector is a molded piece which is fastened against the internal surface of casing 9 so as to be integral therewith. Cold water passing through the openings 24 impinges the deflector 26 so as to be finely sprayed over hot air containing water vapor which is circulating upward through the condensation device 6, thereby causing a partial condensation of a water vapor with a consequent accumulation of the cold water and condensate inside well 14.

The operation of the condensation device 6 according to the present invention will now be described in more detail.

During the washing cycle, the tub 3 is filled with washing liquid to a predetermined maximum level, while the ventilation fan 10 and electric heater 11 are maintained in an off state and regulator valve 23 is turned to a closed position. Thus, cooling water is not introduced onto the spiral wall 20 through tube 21. Subsequently, the washing liquid is completely discharged from the tub 3 at the end of the washing cycle and the machine is ready to carry out the drying cycle.

At such time, the ventilation fan 10 and electric heater 11 are turned on thereby establishing a flow of hot air along a drying circuit through the interior of basket 5, conduit structure 12, at least one condenser conduit 18, and conduit structure 13 so as to dry laundry contained in the basket 5. In this way, the laundry is progressively dried by hot air circulating in the drying circuit in the direction indicated by arrows B and the water vapor produced during the drying cycle is suctioned by the ventilation fan 10 and circulates along the drying circuit along with the hot air.

Under these conditions, the regulator valve 23 is excited so as to move to the open position thereof whereby cold water is introduced through tube 21 into the condensation device 6. The cold water travels along the spiral conveying path alongside the external surface of condenser conduit 18. Consequently, the at least one condenser conduit 18 is cooled by the cold water resulting in the condensation of hot water vapors circulating upward through the at least one condenser conduit 18. In particular, since the speed at which the hot water vapor rises through the condensation device 6 is limited due to the reduction in available flow area at the tapered upper part 31 of casing 9 and due to the relatively slow rate at which cooling water passes over the longitudinal extent of the external surface of condenser conduit 18 along the spiral conveying path, the relative speed between the rising hot water vapor and the cooling water in the condenser is relatively low. Consequently, a highly efficient condensation of the hot water vapors is effected, the efficiency at which the laundry is dried by the hot air is increased, and a relatively low amount of power is consumed by the electric heater 11 to dry a given quantity of laundry.

It should also be noted that the presence of condensate in the accumulation well 14 also contacts hot vapors circulating in the drying circuit. Accordingly, there is a partial condensation of these vapors even before they reach the at least one condenser conduit 18, thereby contributing to even a further increase in the efficiency in reducing the amount of vapors circulating with the hot air.

The bottom of the well 14 may also communicate with a discharge channel 40 open between the well 14 and the inside of tub 3. The discharge channel 40 can extend in a downward inclination from the well 14 to the interior of tub 3 whereby condensate accumulated in well 14 at the end of each drying cycle can be introduced into the tub and then discharged from the same by pump 8, for example.

In addition, rather than having "a touching edge" to limit the extent to which condensate may accumulate in well 14, conduit structure 12 may have a bottom wall open between and slightly inclined from the bottom of accumulation well 14 and the tub 3. Such a bottom wall will directly convey the condensate from the accumulation well 14 into the tub, little by little, so as to limit the extent to which condensate will accumulate in well 14 and yet discharge condensate from the well 14 to the tub 3 for the subsequent discharge thereof from the machine.

It should be noted that other changes and modifications will become apparent to those of ordinary skill in the art. Therefore, all such changes and modifications are seen to be included in the true spirit and scope of the present invention as defined by the appending claims.

What is claimed is:

1. In an appliance having a housing, a basket for containing laundry rotatably supported in the housing, and hot air circulation means, including a ventilation fan and an electric heater forming a drying circuit with the interior of the basket, for circulating hot air through the interior of the basket from a lower part to an upper part thereof to dry laundry, a steam condensation device for condensing vapors in the hot air circulated by said hot air circulation means, said steam condensation device comprising:

a tubular casing extending vertically in the housing;

at least one condenser conduit extending vertically and supported within said casing so that an annular space is defined between internal and external surfaces of said casing and said at least one condenser conduit, respectively, said at least one condenser conduit having a lower end communicating with the lower part of the basket, and an upper end communicating with the upper part of the basket via the ventilation fan and electric heater so as to be connected in the drying circuit in a manner which allows hot air to pass therethrough along the drying circuit;

cold water supply means for introducing a supply of cold water at a specified location in the condensation device;

a spiral wall disposed between the respective internal and external surfaces of said at least one condenser conduit and said casing, and extending spirally from adjacent said location toward the lower end of said at least one condenser conduit so as to define a spiral conveying path alongside the external surface of said at least one condenser conduit along which path cold water from said cold water supply means can travel to cool said at least one condenser conduit and thereby condense vapors in hot air passing therethrough; and conduit structure extending between the lower part of the basket and the lower end of said at least one condenser conduit and defining a well below the lower end of said at least one condenser conduit for accumulating condensate of vapors in hot air passing through said at least one condenser conduit, said conduit structure including a wall terminating at a lateral edge forming an upper part of said well.

2. The steam condensation device in an appliance as claimed in claim 1, wherein said spiral wall has a bottom portion extending in a loop around said at least one condenser conduit, and defines a plurality of openings through said bottom portion communicating with said well.

3. The steam condensation device in an appliance as claimed in claim 2, wherein said casing has an upper tapered end connected in the drying circuit between the upper end of said at least one condenser conduit and both the ventilation fan and electric heater, and a deflector extending below the openings defined by the

4. The steam condensation device an appliance as claimed in claim 1, wherein said conduit structure defines a discharge channel open to said well for allowing liquid in said well to be discharged therefrom, and a cleaning aperture extending therethrough, and further includes a removable plug in said cleaning aperture.

5. Condenser structure for use in an appliance in which a drying operation is carried out, said structure comprising:

a tubular casing;

a least one condenser conduit extending and supported within said casing so that an annular space is defined between internal and external surfaces of said casing and said at least one condenser conduit, respectively; and a spiral wall disposed between the respective internal and external surfaces of said at least one condenser conduit and said casing so as to define a spiral conveying path alongside the external surface of said at least one conduit, and a spiral wall having a bottom portion extending in a loop around said at least one condenser conduit, and defining a plurality of openings through said bottom portion.

6. Condenser structure for use in an appliance as claimed in claim 5, wherein said casing has a deflector extending below the openings defined through the bottom portion of said spiral wall.

7. Condenser structure for use in an appliance as claimed in claim 5, wherein said tubular casing has an upper tapered part.

8. Condenser structure for use in an appliance as claimed in claim 7, wherein said casing has a deflector extending below the openings defined through the bottom portion of said spiral wall.

9. Condenser structure for use in an appliance as claimed in claim 5, and further comprising conduit structure connected to a lower end of said casing, said conduit structure defining a well below a lower end of said at least one conduit, and said conduit structure including a well defining a lateral edge forming an upper part of said well.

10. Condenser structure for use in an appliance as claimed in claim 9, wherein said conduit structure defines a discharge channel open to said well for allowing liquid in said well to be discharged therefrom, and a cleaning aperture extending therethrough, and further includes a removable plug in said cleaning aperture.

11. Condenser structure for use in an appliance as claimed in claim 9, wherein said plurality of openings defined through the bottom portion of said spiral wall communicate with said well.

12. Condenser structure for use in an appliance as claimed in claim 11, wherein said casing has a deflector extending below the openings defined through the bottom portion of said spiral wall.

13. Condenser structure for use in an appliance as claimed in claim 9, wherein said tubular casing has an upper tapered part.

14. Condenser structure for use in an appliance as claimed in claim 13, wherein said plurality of openings defined through the bottom portion of said spiral wall communicate with said well.

15. Condenser structure for use in an appliance as claimed in claim 14, wherein said casing has a deflector extending below the openings defined through the bottom portion of said spiral wall.

* * * * *